US006661323B2

(12) United States Patent
Chang et al.

(10) Patent No.: US 6,661,323 B2
(45) Date of Patent: Dec. 9, 2003

(54) SURFACE MOUNTING DEVICE AND ITS USED SUPPORT

(75) Inventors: Ying Teng Chang, Yunlin Hsien (TW); Ming Yeh, Banchiau (TW); Heng Cheng Chou, Shinjuang (TW)

(73) Assignee: Delta Electronics, Inc., Taoyuan Sien (TW)

( * ) Notice: Subject to any disclaimer, the term of this patent is extended or adjusted under 35 U.S.C. 154(b) by 34 days.

(21) Appl. No.: 10/116,620

(22) Filed: Apr. 3, 2002

(65) Prior Publication Data

US 2002/0190829 A1 Dec. 19, 2002

(30) Foreign Application Priority Data

Jun. 18, 2001 (TW) ..... 90210160 U

(51) Int. Cl.[7] ..... H01F 27/06
(52) U.S. Cl. ..... 336/65; 336/200; 336/210
(58) Field of Search ..... 336/65, 200, 83, 336/90, 221, 210

(56) References Cited

U.S. PATENT DOCUMENTS 6,081,180 A * 6/2000 Fernandez et al. ..... 336/90
6,285,272 B1 * 9/2001 Boytor et al. ..... 336/83
6,292,083 B1 * 9/2001 Tajima et al. ..... 336/192
6,359,541 B1 * 3/2002 Watanabe ..... 335/301
6,504,463 B1 * 1/2003 Kato et al. ..... 336/83

FOREIGN PATENT DOCUMENTS

JP 5-121248 * 5/1993 ..... 29/606
JP 2000-269039 * 9/2000

* cited by examiner

*Primary Examiner*—Anh T. Mai
(74) *Attorney, Agent, or Firm*—Thomas, Kayden, Horstemeyer & Risley

(57) ABSTRACT

A support is used to modify an inductive device to a surface mounting device. The inductive device is provided with a core and a coil, and the support includes an electric portion and an isolation portion. The electric portion, having a first surface and a second surface opposite to the first surface, is electrically coupled to the coil. The first surface of the electric portion is in contact with the core. The isolation portion is disposed on the second surface of the electric portion in a manner such that the isolation portion covers one part of the second surface of the electric portion. The isolation portion is flush with the other part of the second surface of the electric portion.

20 Claims, 8 Drawing Sheets

SURFACE MOUNTING DEVICE AND ITS USED SUPPORT

BACKGROUND OF THE INVENTION

1. Field of the Invention

The invention relates to a surface mounting device and its used support; in particular, to a surface mounting inductor and its used support.

2. Description of the Related Art

Generally, conventional surface mounting inductors are divided into several types. Referring to FIG. 1*a* and FIG. 1*b*, a surface mounting inductor 10 without a support is shown. Such surface mounting inductor 10 is provided with an iron core 11 and a coil 12. The coil 12 must be directly soldered to the bottom 111, as shown in FIG. 1*c*, of the iron core 11.

When the surface mounting inductor 10 is mounted on a printed circuit board (not shown), it cannot be isolated from the printed circuit board. Thus, circuits on the printed circuit board cannot pass through the bottom 111 of the iron core 11. As a result, the layout of the circuit requires additional space and the size of the whole printed circuit board increases.

Referring to FIG. 2*a*, FIG. 2*b*, FIG. 3*a* and FIG. 3*b*, other surface mounting inductors 20, 30 are shown. The surface mounting inductor 20 is provided with an iron core 21, a coil 22 and a support 23, and the surface mounting inductor 30 is provided with an iron core 31, a coil 32 and a support 33. The support 23 is provided with a pin 231, and the support 33 is provided with a pin 331. The coil 22 winds around the pin 231, and the coil 32 winds around the pin 331.

Electrodes of the surface mounting inductors 20, 30 are formed by L-shaped metal supports 23, 33 glued to the bottom of the iron core 21, 31. Since the fabricating process of the surface mounting inductors 20, 30 are simple, the manufacturing cost of the surface mounting inductors 20, 30 is lower than that of the surface mounting inductor 10. However, the surface mounting inductors 20, 30 have the same disadvantage as the surface mounting inductor 10. That is, when the surface mounting inductors 20, 30 are mounted on the printed circuit board, they cannot be isolated from the printed circuit board.

Referring to FIG. 4*a* and FIG. 4*b*, another surface mounting inductor 40 is shown. The surface mounting inductor 40 is provided with an iron core 41, a coil 42, a support 43, and two L-shaped metal parts 44. The coil 42 is soldered to the support 43. The L-shaped metal parts 44 are used as electrodes, and partially inserted into holes 45 of the support 43.

Referring to FIG. 5*a* and FIG. 5*b*, another surface mounting inductor 50 is shown. The surface mounting inductor 50 is provided with an iron core 51, a coil 52, a support 53, and two U-shaped metal parts 54. The support 53 is provided with an upper surface 531 and a flat bottom surface (not shown). The upper surface 531 is provided with a concave portion 531*a* with the iron core 51 disposed thereupon. The U-shaped metal parts 54 are used as electrodes, and fit with the circumference of the support 53. The coil 52 is soldered to the U-shaped metal parts 54. When the surface mounting inductor 50 is mounted on the printed circuit board, the bottom surfaces of the U-shaped metal parts 54 are in contact with the printed circuit board.

The surface mounting inductors 40, 50 have the following disadvantages:

1. Since the L-shaped metal parts 44 and the U-shaped metal parts 54 are disposed on the support 43, 53, the bottom surfaces of the supports 43, 53 are uneven; and 2. Since the supports 43, 53 are made of plastic, the strength of the supports 43, 53 is insufficient and the supports 43, 53 are easily damaged when the profile of the supports 43, 53 is thin. In contrast, when the thickness of the supports 43, 53 increases, the thickness of the whole surface mounting inductors 40, 50 also increases.

SUMMARY OF THE INVENTION

In order to address the disadvantages of the aforementioned surface mounting inductor, the invention provides a surface mounting inductor with an isolation support.

Another purpose of this invention is to provide a support for a surface mounting device having an inductive device.

Accordingly, the invention provides a support for modifying an inductive device to a surface mounting device. The inductive device is provided with a core and a coil, and the support includes an electric portion and an isolation portion. The electric portion, having a first surface and a second surface opposite to the first surface, is electrically coupled to the coil. The first surface of the electric portion is in contact with the core. The isolation portion is disposed on the second surface of the electric portion in a manner such that the isolation portion covers one part of the second surface of the electric portion. The isolation portion is flush with the other part of the second surface of the electric portion.

In a preferred embodiment, the electric portion is a metal plate with an L-shaped cross-section.

In another preferred embodiment, the electric portion includes two metal plates respectively having an L-shaped cross-section.

Furthermore, the metal plates are integrally formed.

In another preferred embodiment, the electric portion is a metal plate with a U-shaped cross-section.

In another preferred embodiment, the electric portion is provided with a plurality of pins for the coil winding thereon.

Furthermore, each of the pins is provided with a notch for leading the coil.

In another preferred embodiment, the electric portion is glued to the core.

In another preferred embodiment, the isolation portion is a paint layer coating on the one part of the second surface of the electric portion.

In another preferred embodiment, the isolation portion is a plastic film glued to the one part of the second surface of the electric portion.

In another preferred embodiment, this invention provides a surface mounting device. It includes a core, a coil, an electric portion and an isolation portion. The coil winds around the core. The electric portion, having a first surface and a second surface opposite to the first surface, is electrically coupled to the coil. The first surface of the electric portion is in contact with the core. The isolation portion is disposed on the second surface of the electric portion in a manner such that the isolation portion covers one part of the second surface of the electric portion. The isolation portion is flush with the other part of the second surface of the electric portion.

BRIEF DESCRIPTION OF THE DRAWINGS

The invention is hereinafter described in detail with reference to the accompanying drawings in which.

DETAILED DESCRIPTION OF THE INVENTION

First Embodiment

Figure 1A:
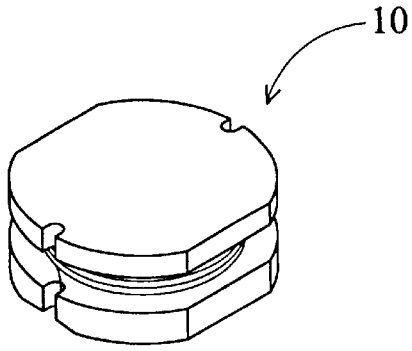
FIG. 1a (PRIOR ART)
FIG. 1*a* is a schematic view of a conventional surface mounting inductor without a support.
Figure 1B:
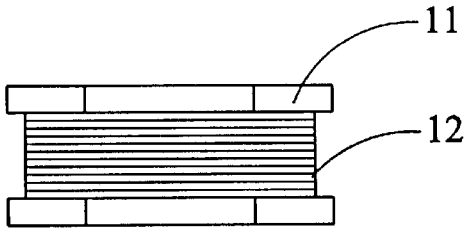
FIG. 1b (PRIOR ART)
FIG. 1*b* is a side view of the surface mounting inductor in FIG. 1*a;*
Figure 1C:
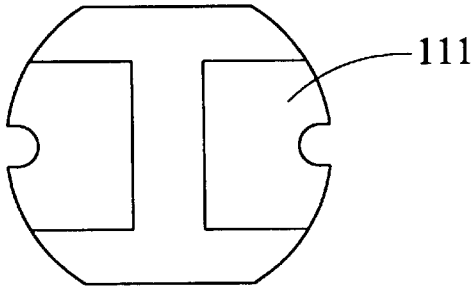
FIG. 1c (PRIOR ART)
FIG. 1*c* is a bottom view of the surface mounting inductor in FIG. 1*a;*
Figure 2A:
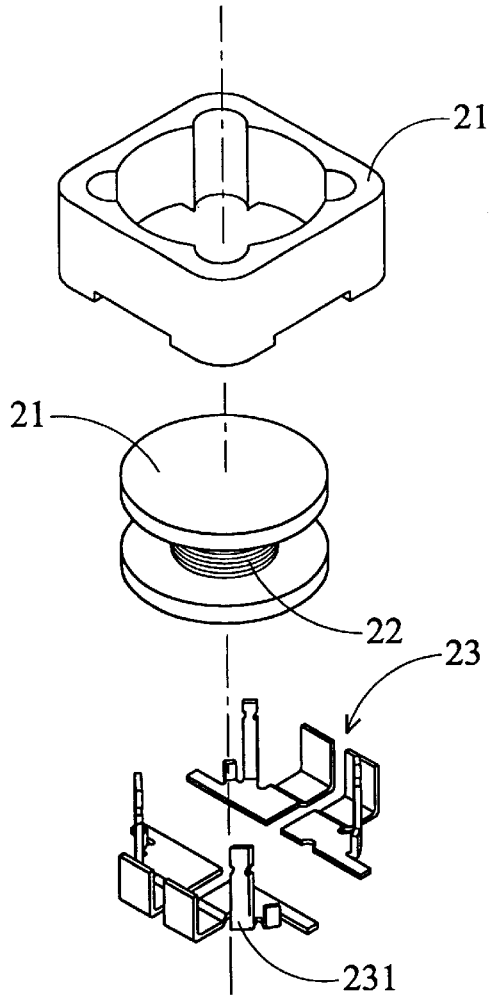
FIG. 2a (PRIOR ART)
FIG. 2*a* is an exploded view that shows another conventional surface mounting inductor.
Figure 2B:
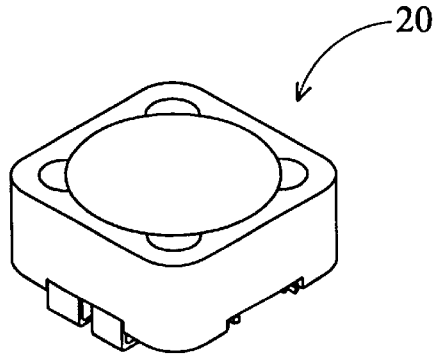
FIG. 2b (PRIOR ART)
FIG. 2*b* is a schematic view of the surface mounting inductor in FIG. 2*a;*
Figure 3A:
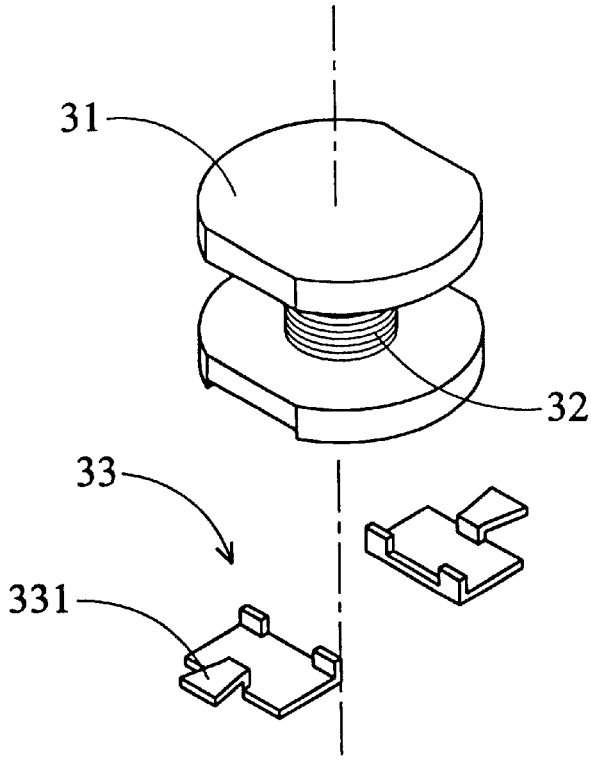
FIG. 3a (PRIOR ART)
FIG. 3*a* is an exploded view that shows another conventional surface mounting inductor.
Figure 3B:
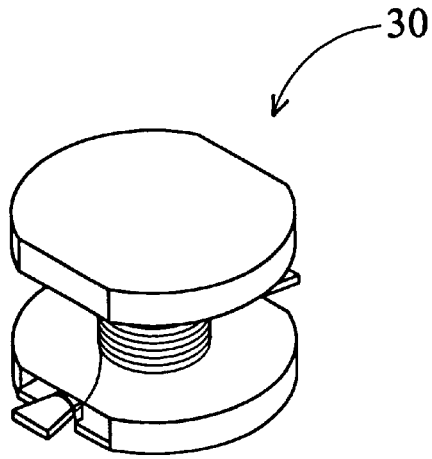
FIG. 3b (PRIOR ART)
FIG. 3*b* is a schematic view of the surface mounting inductor in FIG. 3*a;*
Figure 4A:
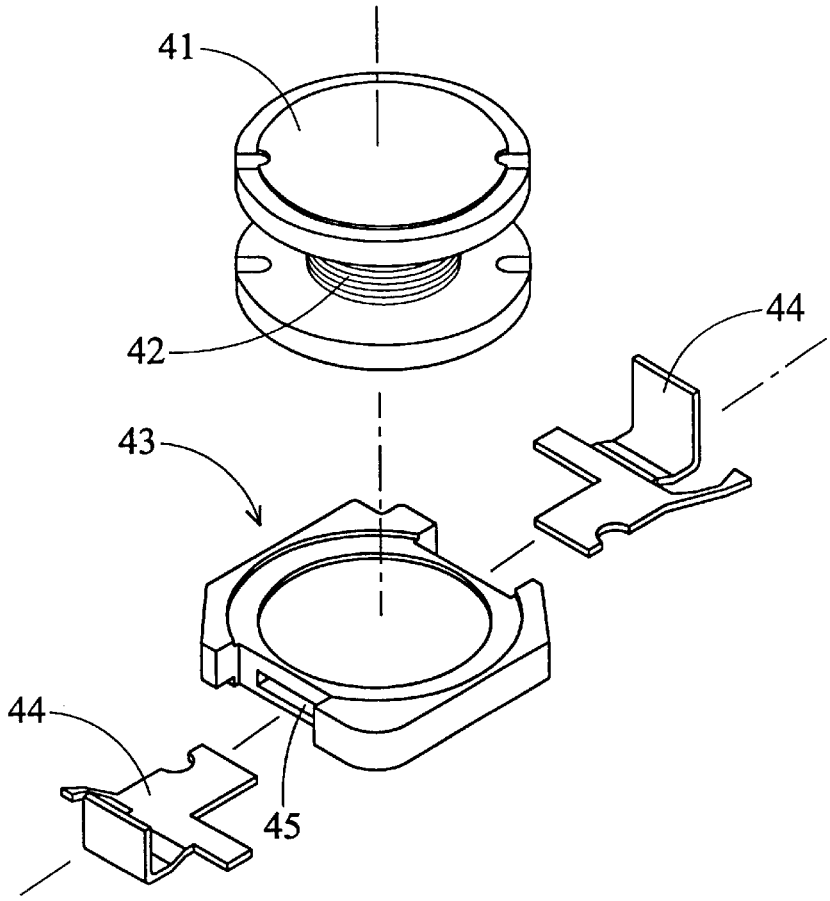
FIG. 4a (PRIOR ART)
FIG. 4*a* is an exploded view that shows another conventional surface mounting inductor.
Figure 4B:
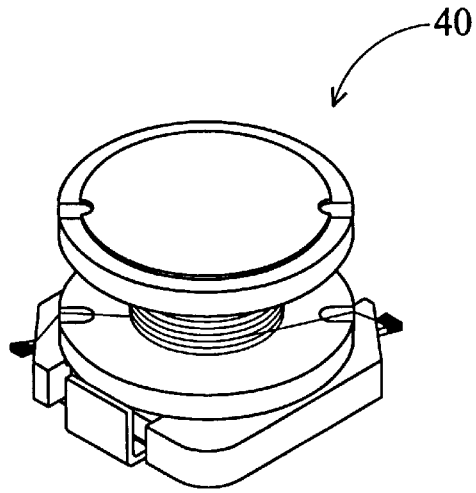
FIG. 4b (PRIOR ART)
FIG. 4*b* is a schematic view of the surface mounting inductor in FIG. 4*a;*
Figure 5A:
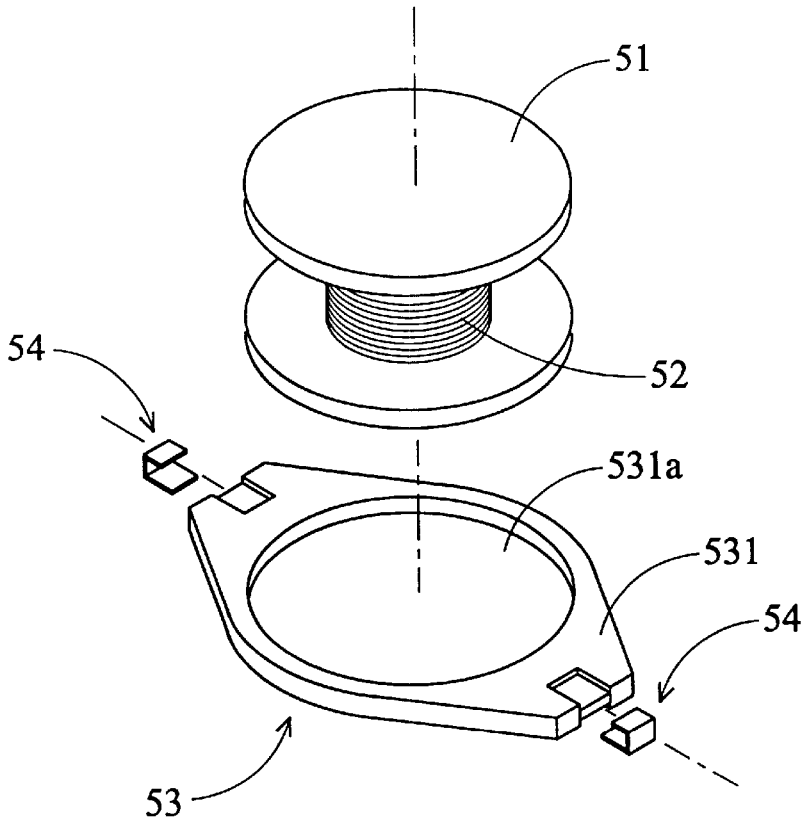
FIG. 5a (PRIOR ART)
FIG. 5*a* is an exploded view that shows another conventional surface mounting inductor.
Figure 5B:
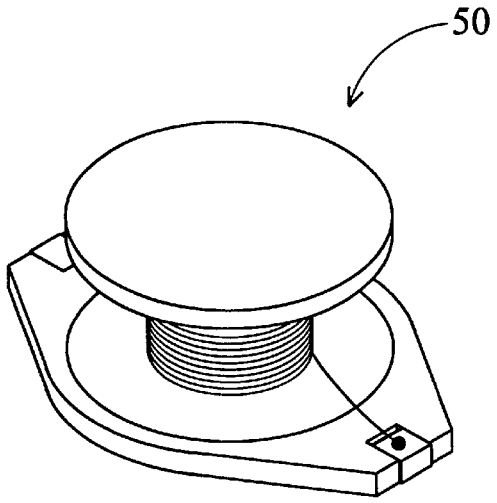
FIG. 5b (PRIOR ART)
FIG. 5*b* is a schematic view of the surface mounting inductor in FIG. 5*a;*
Figure 6A:
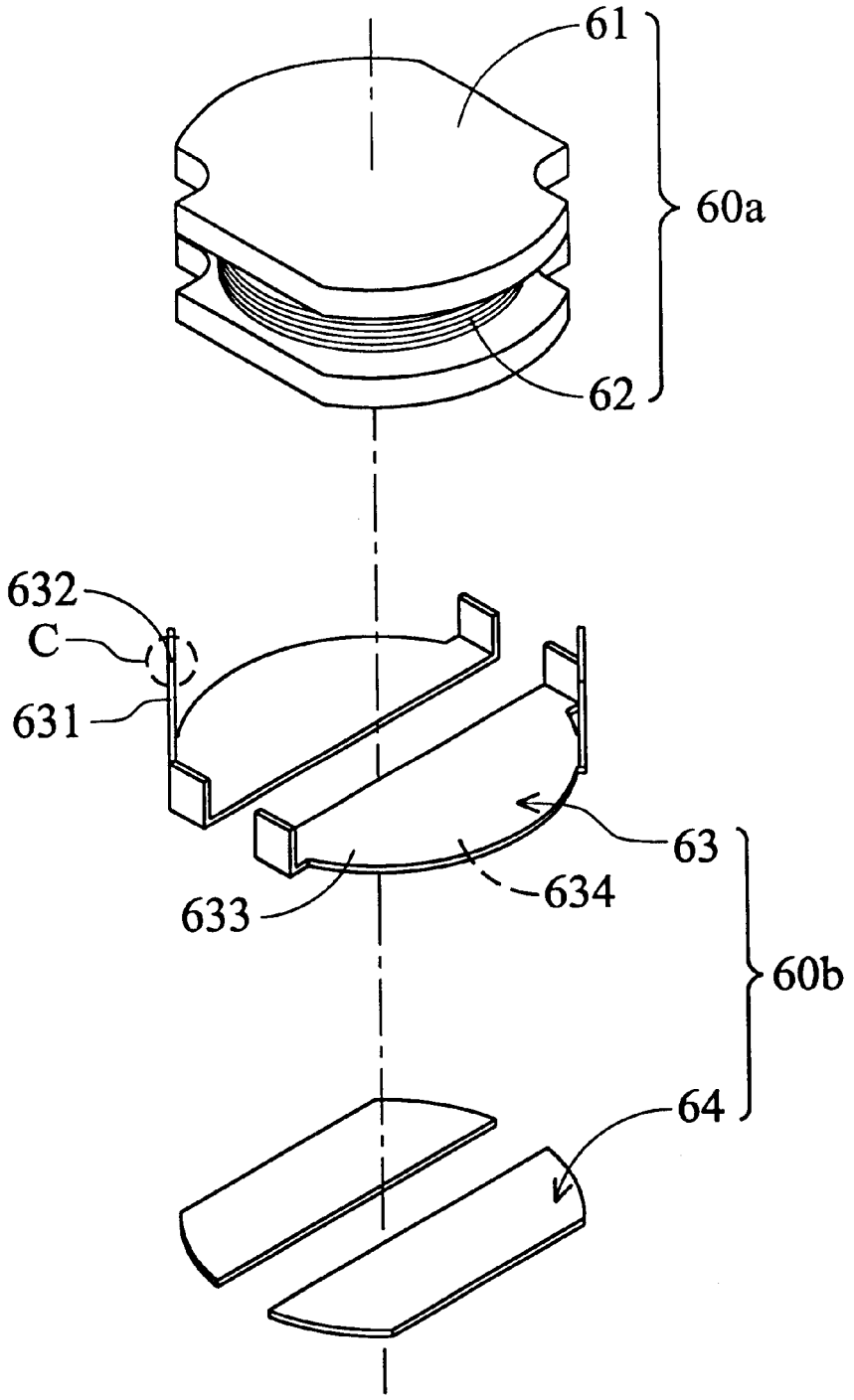
FIG. 6*a* is an exploded view that shows a surface mounting inductor as disclosed in a first embodiment of this invention.
Figure 6B:
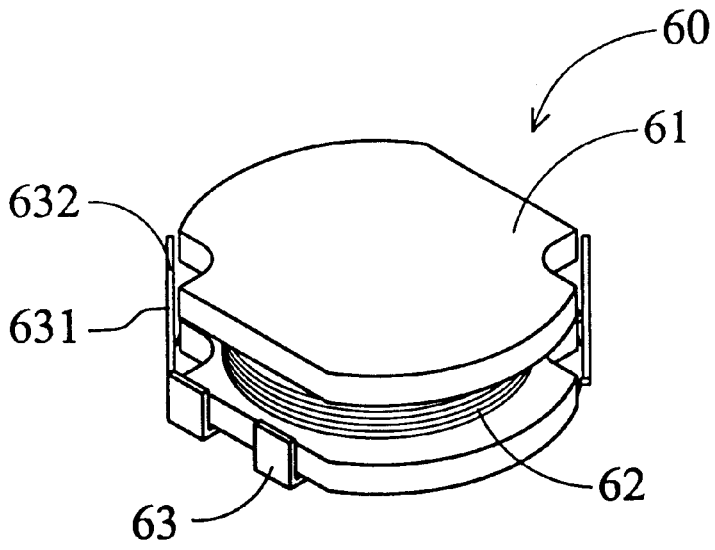
FIG. 6*b* is a perspective view of the surface mounting inductor in FIG. 6*a;*
Figure 6C:
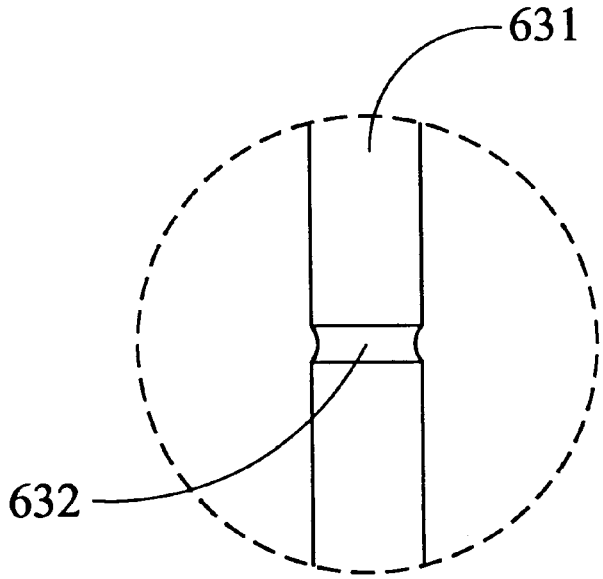
FIG. 6*c* is an enlarged view of part C in FIG. 6*a;*

Referring to FIG. 6*a* and FIG. 6*b*, a support 60*b* as disclosed in a first embodiment of this invention is shown. The support 60*b* is used for modifying an inductor 60*a* to a surface mounting device 60. The inductor 60*a* is provided with a core 61 and a coil 62, and the support 60*b* includes an electric portion 63 and an isolation portion 64. The electric portion 63 is provided with a first surface 633 and a second surface 634 opposite to the first surface 633. The first surface 633 of the electric portion 63 is glued to the bottom of the core 61; that is, it is in contact with the core 61. The electric portion 63 is provided with a plurality of pins 631 for the coil 62 to be wound thereon. The pins 631 bend toward the core 61, and each of the pins 631 is provided with a notch 632 as shown in FIG. 6*c*. Since the coil 62 winds around the notch 632, the notch 632 can lead the coil 62, and the coil 62 can stably wind around the pins 631. Thus, the electric portion 63 is electrically coupled to the coil 62, and there is no need to solder the coil 62 to the electric portion 63. The isolation portion 64 is disposed on the second surface 634 of the electric portion 63 in a manner such that the isolation portion 64 covers one part of the second surface 634 of the electric portion 63. That is, the other part of second surface 634 of the electric portion 63 is not covered by the isolation portion 64, and is exposed to the surroundings. The isolation portion 64 may be a paint layer coating on the one part of the second surface 634 of the electric portion 63, or may be a plastic film glued to one part of the second surface 634 of the electric portion 63. In addition, the isolation portion 64 is flush with the other part of the second surface 634 of the electric portion 63.

As shown in FIG. 6*a*, the electric portion 63 includes two metal plates, and the cross-section of the electric portion 63 may be L-shaped, as shown in FIG. 6*a*, or U-shaped (not shown). However, the electric portion 63 is not limited to this, two metal plates may be integrally formed into one metal plate.

After assembling the core 61, the coil 62, the electric portion 63 and the isolation portion 64, the surface mounting inductor 60 is completed as shown in FIG. 6*b*. Since the isolation portion 64 is flush with the other part of the second surface 634 of the electric portion 63, the surface mounting inductor 60 can be mounted on a printed circuit board (not shown) in a manner such that there is no gap between the surface mounting inductor 60 and the printed circuit board. Thus, the surface mounting inductor 60 is evenly mounted on the printed circuit board. In addition, the other part, not covered by the isolation portion 64, of the second surface 634 of the electric portion 63 can be used as an electrode, and is electrically coupled to the printed circuit board.

Second Embodiment

Figure 7A:
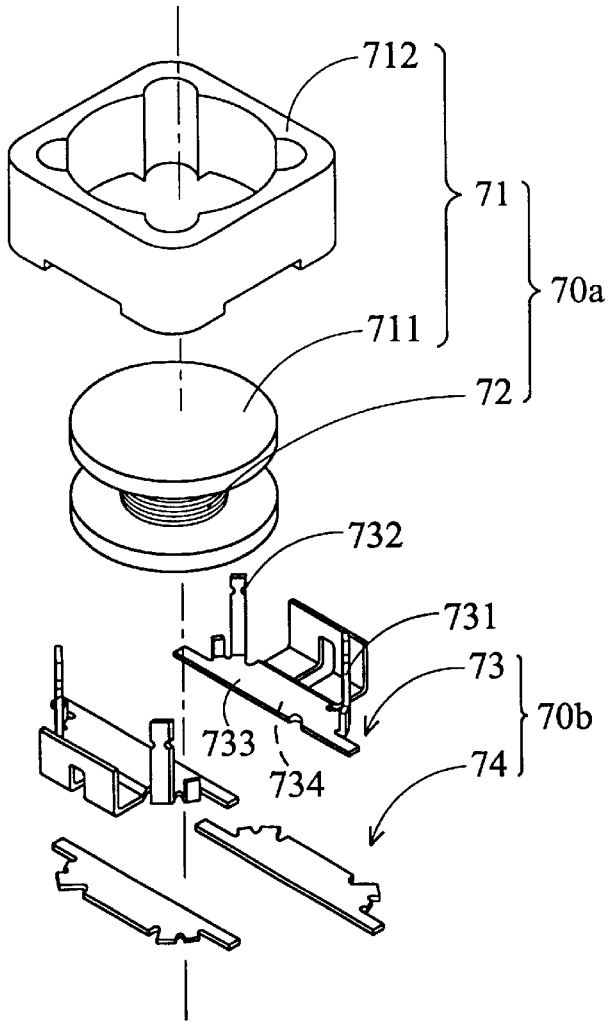
FIG. 7*a* is an exploded view that shows a surface mounting inductor as disclosed in a second embodiment of this invention.
Figure 7B:
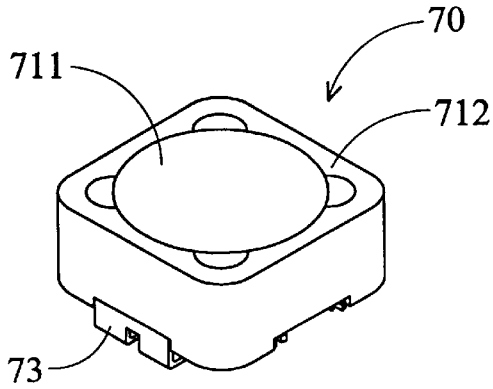
FIG. 7*b* is a perspective view of the surface mounting inductor in FIG. 7*a.*

Referring to FIG. 7*a* and FIG. 7*b*, a support 70*b* as disclosed in a second embodiment of this invention is shown. The support 70*b* is used for modifying an inductor 70*a* to a surface mounting device 70. The inductor 70*a* is provided with a core 71 and a coil 72, and the support 70*b* includes an electric portion 73 and an isolation portion 74. The core 71 includes a drum-typed core 711 and a cap-typed core 712. The electric portion 73 is provided with a first surface 733 and a second surface 734 opposite to the first surface 733. The first surface 733 of the electric portion 73 is glued to the bottom of the core 71; that is, it is in contact with the core 71. The electric portion 73 is provided with a plurality of pins 731 for the coil 72 winding thereon. The pins 731 bend toward the core 71, and each of the pins 731 is provided with a notch 732. Since the coil 72 winds around the notch 732, the notch 732 can lead the coil 72, and the coil 72 can stably wind around the pins 731. Thus, the electric portion 73 is electrically coupled to the coil 72, and there is no need to solder the coil 72 to the electric portion 73. The isolation portion 74 is disposed on the second surface 734 of the electric portion 73 in a manner such that the isolation portion 74 covers one part of the second surface 734 of the electric portion 73. That is, the other part of second surface 734 of the electric portion 73 is not covered by the isolation portion 74, and is exposed to the surroundings. The isolation portion 74 may be a paint layer coating on the one part of the second surface 734 of the electric portion 73, or may be a plastic film glued to the one part of the second surface 734 of the electric portion 73. In addition, the isolation portion 74 is flush with the other part of the second surface 734 of the electric portion 73.

As shown in FIG. 7*a*, the electric portion 73 includes two metal plates, and the cross-section of the electric portion 73 may be L-shaped, as shown in FIG. 7*a*, or U-shaped (not shown). However, the electric portion 73 is not limited to this, two metal plates may be integrally formed into one metal plate.

After assembling the core 71, the coil 72, the electric portion 73 and the isolation portion 74, the surface mounting inductor 70 is fabricated as shown in FIG. 7*b*. Since the isolation portion 74 is flush with the other part of the second surface 734 of the electric portion 73, the surface mounting inductor 70 can be mounted on a printed circuit board (not shown) in a manner such that there is no gap between the surface mounting inductor 70 and the printed circuit board. Thus, the surface mounting inductor 70 is evenly mounted on the printed circuit board. In addition, the other part, not covered by the isolation portion 74, of the second surface 734 of the electric portion 73 can be used as an electrode, and is electrically coupled to the printed circuit board.

As stated above, the support as disclosed in this invention includes the electric portion and the isolation portion, and is used to modify the inductor to the surface mounting device. The electric portion, glued to the core, is used as the electrode, while the isolation portion is disposed between the electric portion and the printed circuit board. Thus, when the surface mounting device as disclosed in this invention is mounted on the printed circuit board, it can be isolated from the printed circuit board. In addition, since there is no gap between the surface mounting inductor and the printed circuit board, the surface mounting inductor can be evenly mounted on the printed circuit board. Furthermore, overall costs are reduced.

While the invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A support for modifying an inductive device to a surface mounting device, wherein the inductive device is provided with a core and a coil, and the support comprises:

an electric portion, having a first surface and a second surface opposite to the first surface, electrically coupled to the coil, wherein the first surface of the electric portion is in contact with the core; and an isolation portion disposed on the second surface of the electric portion in a manner such that the isolation portion covers one part of the second surface of the electric portion, wherein the isolation portion is flush with the other part of the second surface of the electric portion.

2. The support as claimed in claim 1, wherein the electric portion is a metal plate with an L-shaped cross-section.

3. The support as claimed in claim 1, wherein the electric portion comprises two metal plates respectively having an L-shaped cross-section.

4. The support as claimed in claim 3, wherein the metal plates are integrally formed.

5. The support as claimed in claim 1, wherein the electric portion is a metal plate with a U-shaped cross-section.

6. The support as claimed in claim 1, wherein the electric portion is provided with a plurality of pins for the coil to be wound thereon.

7. The support as claimed in claim 6, wherein each of the pins is provided with a notch for leading the coil.

8. The support as claimed in claim 1, wherein the electric portion is glued to the core.

9. The support as claimed in claim 1, wherein the isolation portion is a paint layer coating on the one part of the second surface of the electric portion.

10. The support as claimed in claim 1, wherein the isolation portion is a plastic film glued to the one part of the second surface of the electric portion.

11. A surface mounting device comprising:

a core;

a coil winding around the core;

an electric portion, having a first surface and a second surface opposite to the first surface, electrically coupled to the coil, wherein the first surface of the electric portion is in contact with the core; and an isolation portion disposed on the second surface of the electric portion in a manner such that the isolation portion covers one part of the second surface of the electric portion, wherein the isolation portion is flush with the other part of the second surface of the electric portion.

12. The surface mounting device as claimed in claim 11, wherein the electric portion is a metal plate with an L-shaped cross-section.

13. The surface mounting device as claimed in claim 11, wherein the electric portion comprises two metal plates respectively having an L-shaped cross-section.

14. The surface mounting device as claimed in claim 13, wherein the metal plates are integrally formed.

15. The surface mounting device as claimed in claim 11, wherein the electric portion is a metal plate with a U-shaped cross-section.

16. The surface mounting device as claimed in claim 11, wherein the electric portion is provided with a plurality of pins for the coil to be wound thereon.

17. The surface mounting device as claimed in claim 16, wherein each of the pins is provided with a notch for leading the coil.

18. The surface mounting device as claimed in claim 11, wherein the electric portion is glued to the core.

19. The surface mounting device as claimed in claim 11, wherein the isolation portion is a paint layer coating on the one part of the second surface of the electric portion.

20. The surface mounting device as claimed in claim 11, wherein the isolation portion is a plastic film glued to the one part of the second surface of the electric portion.

* * * * *